US005110309A

United States Patent [19]

Ichitsubo

[11] Patent Number: 5,110,309

[45] Date of Patent: May 5, 1992

[54] MULTI-POLE ELECTRICAL CONNECTOR

[75] Inventor: Norio Ichitsubo, Osaka, Japan

[73] Assignee: Hosiden Corporation, Osaka, Japan

[21] Appl. No.: 621,976

[22] Filed: Dec. 4, 1990

[30] Foreign Application Priority Data

Dec. 14, 1989 [JP] Japan ..... 1-144849[U]

[51] Int. Cl.[5] ..... H01R 13/00

[52] U.S. Cl. ..... 439/630

[58] Field of Search ..... 439/629-637, 439/924

[56] References Cited

U.S. PATENT DOCUMENTS 3,660,803 5/1972 Cooney ..... 439/637

4,932,885 6/1990 Scholz ..... 439/637

*Primary Examiner*—Joseph McGlynn

*Attorney, Agent, or Firm*—Jones, Tullar & Cooper, P.C.

[57] ABSTRACT

The present invention provides a multi-pole electrical connector for which mounting on a printed circuit board is simplified and which may be made as a compact design.

The multi-pole electrical conenctor of the present invention includes pieces divided into upper contact pieces and lower contact pieces which are respectively disposed in a main body in upper and lower stages. The respective contact pieces have contacts which correspond to external contacts of a printed circuit board and also have contacts which correspond to contacts of another multi-pole electrical connector. The multi-pole electrical connector may be mounted on a printed circuit board and connected to another multi-pole electrical connector by contacting the contacts of the multi-pole electrical connector with the contacts of the printed circuit board and the contacts of the other multi-pole electrical connector. The multi-pole electrical connector of the present invention may achieve a high-density mounting of a great number of contacts and a compact design of the entire configuration.

6 Claims, 6 Drawing Sheets

FIG. 6
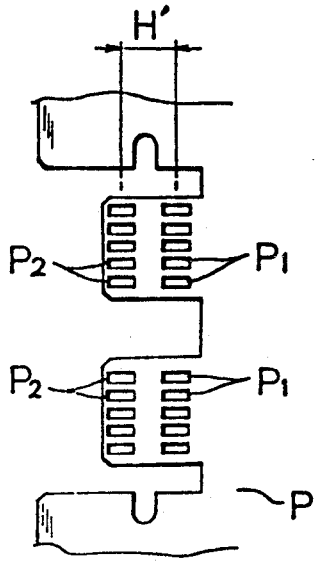
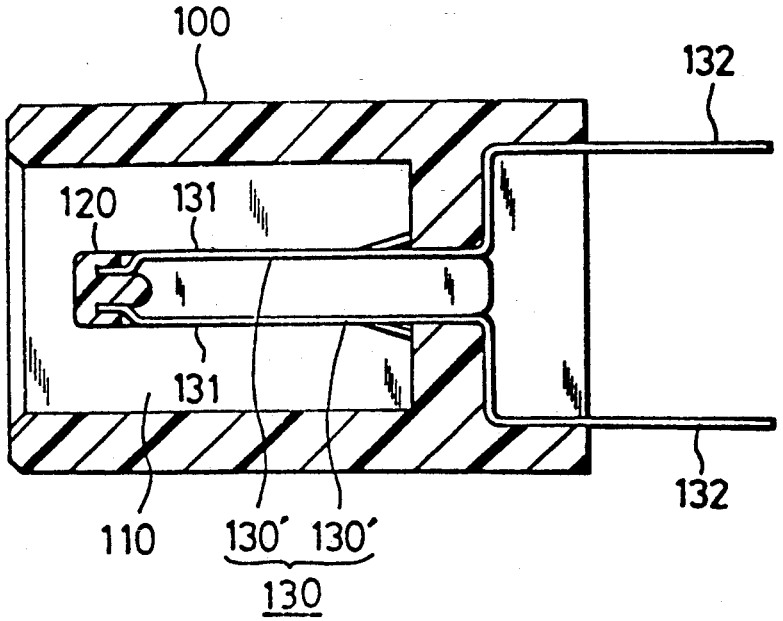
FIG. 7

MULTI-POLE ELECTRICAL CONNECTOR

BACKGROUND OF THE INVENTION

1. Field of the Invention

The present invention relates to a multi-pole electrical connector to be used as a plug or a socket.

The multi-pole electrical connector refers to an electrical connector having a number of poles. When a multi-pole electrical connector is so arranged as to be used as a socket, there is selected, as the counter member, another multi-pole electrical connector so arranged as to be used as a plug.

2. Description of the Prior Art

FIG. 7 schematically shows a conventional multi-pole electrical connector of the socket type.

In FIG. 7, the multi-pole electrical connector has a main body 100 including a connector insertion hole 110 into and from which a multi-pole electrical connector of the plug type (not shown) is to be inserted and removed, and a contact piece holding portion 120 which projects in the connector insertion hole 110. A contact piece 130' having a contact 131 is disposed at the top surface of the contact piece holding portion 120, while a contact piece 130' having a contact 131 is disposed at the bottom surface of the contact piece holding portion 120. These contact pieces 130' extend to the outside of the main body 100. These extending portions serve as terminals 132 to be soldered. These two contact pieces 130' respectively disposed at the top and lower sides of the contact piece holding portion 120, form a pair of contact pieces 130. A number of (for example, ten) such pairs of contact pieces 130 are disposed, as juxtaposed, at the contact piece holding portion 120. The terminals 132 to be soldered are adapted to be soldered to the soldering land of a printed circuit board (not shown).

The conventional multi-pole electrical connector having the arrangement mentioned above presents the following problem.

When the terminals 132 to be soldered of the conventional multi-pole electrical connector are once soldered to a printed circuit board, it is difficult to easily replace the multi-pole electrical connector even though the same should be replaced due to the wear and tear of the contacts 131.

Further, a great number of pairs of contact pieces are juxtaposed in one line at the contact piece holding portion 120. Accordingly, as the number of pairs of contact pieces 130 is increased, the transverse width of the entire connector is increased. This disadvantageously widens the space required for mounting the connector on a printed circuit board.

SUMMARY OF THE INVENTION

The present invention is proposed in view of the problems above-mentioned.

It is an object of the present invention to provide a multi-pole electrical connector which is mounted on a printed circuit board without the need for soldering.

It is another object of the present invention to provide a multi-pole electrical connector transverse width of which is shortened for the number of poles, thus enabling reduction in the space for mounting the multi-pole electrical connector on a printed circuit board.

It is a further object of the present invention to provide a multi-pole electrical connector the thickness of which is reduced.

To achieve the objects mentioned above, the multi-pole electrical connector in accordance with an embodiment of the present invention comprises:

a main body having a connector insertion hole into and from which another multi-pole electrical connector is to be inserted and removed, and a board insertion hole into and from which a printed circuit board is to be inserted and removed;

upper and lower contact piece holding portions formed integrally with the main body and projecting, in two (upper and lower) stages, inside of the connector insertion hole of the main body;

a plurality of upper pairs of contact pieces disposed as juxtaposed, each pair including two contact pieces respectively disposed at the top surface side and the bottom surface side of the upper contact piece holding portion;

upper contacts respectively formed on the two contact pieces forming each of the upper pairs of contact pieces, the upper contacts corresponding to contacts of the other multi-pole electrical connector;

upper extending portions which respectively extend from the two contact pieces forming each of the upper pairs of contact pieces and which reach the inside of the board insertion hole;

two upper contacts respectively formed on the upper extending portions of the two contact pieces forming each of the upper pairs of contact pieces, the two upper contacts being positionally shifted, in the insertion/-removal direction of the printed circuit board, correspondingly to external contacts formed on the top surface side of the printed circuit board;

a plurality of lower pairs of contact pieces disposed as juxtaposed, each pair including two contact pieces respectively disposed at the top surface side and the bottom surface side of the lower contact piece holding portion;

lower contacts respectively formed on the two contact pieces forming each of the lower pairs of contact pieces, the lower contacts corresponding to contacts of the other multi-pole electrical connector;

lower extending portions which respectively extend from the two contact pieces forming each of the lower pairs of contact pieces and which reach the inside of the board insertion hole; and two lower contacts respectively formed on the lower extending portions of the two contact pieces forming each of the lower pairs of contact pieces, the two lower contacts being positionally shifted, in the insertion/-removal direction of the printed circuit board, correspondingly to external contacts formed on the bottom surface side of the printed circuit board.

In the multi-pole electrical connector having the arrangement mentioned above, when a printed circuit board is inserted into the board insertion hole of the main body, the upper contacts come in contact with the external contacts on the top surface of the printed circuit board, while the lower contacts come in contact with the external contacts on the bottom surface of the printed circuit board. At the same time, the multi-pole electrical connector is mounted on the printed circuit board. On the contrary, when the printed circuit board is pulled out from the board insertion hole of the main body, the multi-pole electrical connector is removed from the printed circuit board. This advantageously eliminates the necessity of soldering for mounting the multi-pole electrical connector on the printed circuit board. Further, when it becomes necessary to replace the multi-pole electrical connector due to wear and tear of the contact pieces or the like, the connector may be readily replaced with a new one without soldering required.

The pairs of contact pieces are divided into the upper and lower pairs of contact pieces, which are respectively disposed, as separated from each other, at the upper contact piece holding portion and the lower contact piece holding portion. Accordingly, such an arrangement may reduce the entire transverse width by half or substantially by half, as compared with the arrangement in which all the pairs of contact pieces are juxtaposed in one line. Yet, since the contacts of the contact pieces corresponding to the external contacts of the printed circuit board are positionally shifted in the insertion/removal direction of the printed circuit board, a number of poles may be assured without force. This achieves a high-density mounting of a great number of contacts and a compact design of the entire configuration of the multi-pole electrical connector.

According to the present invention, the respective upper extending portions may be opposite to the respective lower extending portions with respect to the insertion/removal passage of a printed circuit board.

According to the multi-pole electrical connector mentioned above, too, it is possible to achieve a high-density mounting of a number of contacts and a compact design of the entire configuration.

According to the present invention, engagement grooves and concave portions may be respectively disposed at different positions of the tip portion of the upper contact piece holding portion, these different positions being shifted in the longitudinal direction of the connector, and pawls formed on the respective tips of the two contact pieces forming each of the upper pairs of contact pieces may be respectively fitted in one of the engagement grooves and one of the concave portions.

According to the multi-pole electrical connector having the arrangement mentioned above, the pawls respectively formed on the tips of the two contact pieces forming each of the upper pairs of contact pieces overlap each other at the tip portion of the upper contact piece holding portion in the longitudinal direction, but do not overlap each other in the height (depth) direction. Accordingly, the upper contact piece holding portion may be reduced in thickness. It is therefore easier to satisfy the demand for a thin multi-pole electrical connector for the same reasons mentioned above.

According to the present invention, engagement grooves and concave portions may be respectively disposed at different positions of the tip portion of the lower contact piece holding portion, these different positions being shifted in the longitudinal direction of the connector, and pawls formed on the respective tips of the two contact pieces forming each of the lower pairs of contact pieces may be respectively fitted in one of the engagement grooves and one of the concave portions.

According to the multi-pole electrical connector mentioned above, too, it is easier to satisfy the demand for a thin multi-pole electrical connector, for the same reasons mentioned above.

To achieve the objects mentioned above, the multi-pole electrical connector in accordance with another embodiment of the present invention comprises:

a main body having a connector insertion hole into and from which another multi-pole electrical connector is to be inserted and removed, and a board insertion hole into and from which a printed circuit board is to be inserted and removed;

a single contact piece holding portion formed integrally with the main body and projecting inside of the connector insertion hole;

a plurality of upper pairs of contact pieces disposed as juxtaposed, each pair including two contact pieces respectively disposed at the top surface side of the contact piece holding portion and at the inner surface side of the upper wall of the main body;

upper contacts respectively formed on the two contact pieces forming each of the upper pairs of contact pieces, these upper contacts corresponding to contacts of the other multi-pole electrical connector;

upper extending portions which respectively extend from the two contact piece forming each of the upper pairs of contact pieces and which reach the inside of the board insertion hole;

two upper contacts respectively formed on the upper extending portions of the two contact pieces forming each of the upper pairs of contact pieces, the two upper contacts being positionally shifted, in the insertion/removal direction of the printed circuit board, correspondingly to external contacts formed on the top surface side of the printed circuit board;

a plurality of lower pairs of contact pieces disposed as juxtaposed, each pair including two contact pieces respectively disposed at the bottom surface side of the contact piece holding portion and at the inner surface side of the lower wall of the main body;

lower contacts respectively formed on the two contact pieces forming each of the lower pairs of contact pieces, the lower contacts corresponding to contacts of the other multi-pole electrical connector;

lower extending portions which respectively extend from the two contact pieces forming each of the lower pairs of contact pieces and which reach the inside of the board insertion hole; and two lower contacts respectively formed on the lower extending portions of the two contact pieces forming each of the lower pairs of contact pieces, the two lower contacts being positionally shifted, in the insertion/removal direction of the printed circuit board, correspondingly to external contacts formed on the under surface side of the printed circuit board.

In the multi-pole electrical connector having the arrangement mentioned above, when a printed circuit board is inserted into the board insertion hole of the main body, the upper contacts come in contact with the external contacts on the top surface of the printed circuit board, while the lower contacts come in contact with the external contacts on the under surface of the printed circuit board. At the same time, the multi-pole electrical connector is mounted on the printed circuit board. On the contrary, when the printed circuit board is pulled out from the board insertion hole of the main body, the multi-pole electrical connector is removed from the printed circuit board. This advantageously eliminates the necessity of soldering for mounting the multi-pole electrical connector on the printed circuit board. Further, when it becomes necessary to replace the multi-pole electrical connector due to wear and tear of the contact pieces or the like, the connector may be readily replaced with a new one without soldering required.

The pairs of contact pieces are divided into the upper and lower pairs of contact pieces, which are respectively disposed, as separated from each other, at the upper and lower portions of the contact piece holding portion. Accordingly, such an arrangement may reduce the entire transverse width by half or substantially by half, as compared with the arrangement in which all the pairs of contact pieces are juxtaposed in one line. Yet, since the contacts of the contact pieces corresponding to the external contacts of the printed circuit board are positionally shifted in the insertion/removal direction of the printed circuit board, a number of poles may be assured without force. This readily achieves a high-density mounting of a great number of contacts and a compact design of the entire configuration of the multi-pole electrical connector.

According to the present invention, the respective upper extending portions may be opposite to the respective lower extending portions with respect to the insertion/removal passage of the printed circuit board.

According to the multi-pole electrical connector mentioned above, too, it is possible to achieve a high-density mounting of a number of contacts and a compact design of the entire configuration of the multi-pole electrical connector.

BRIEF DESCRIPTION OF DRAWINGS

FIG. 6 is a plan view of main portions of a printed circuit board; and

FIG. 7 is a vertical section view of a conventional multi-pole electrical connector.

DETAILED DESCRIPTION OF THE PREFERRED EMBODIMENTS

Figure 1:
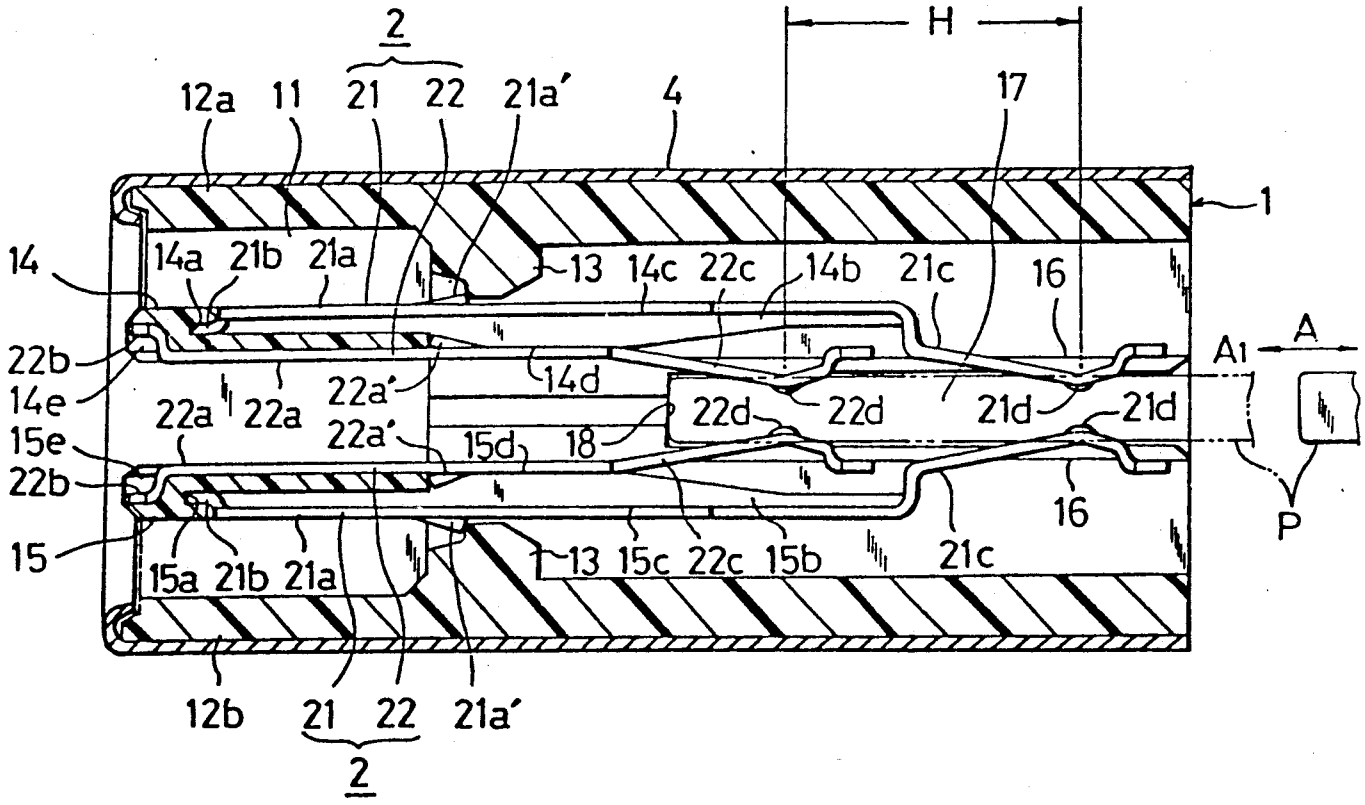
FIG. 1 is a vertical section view of a multi-pole electrical connector in accordance with an embodiment of the present invention.
Figure 2:
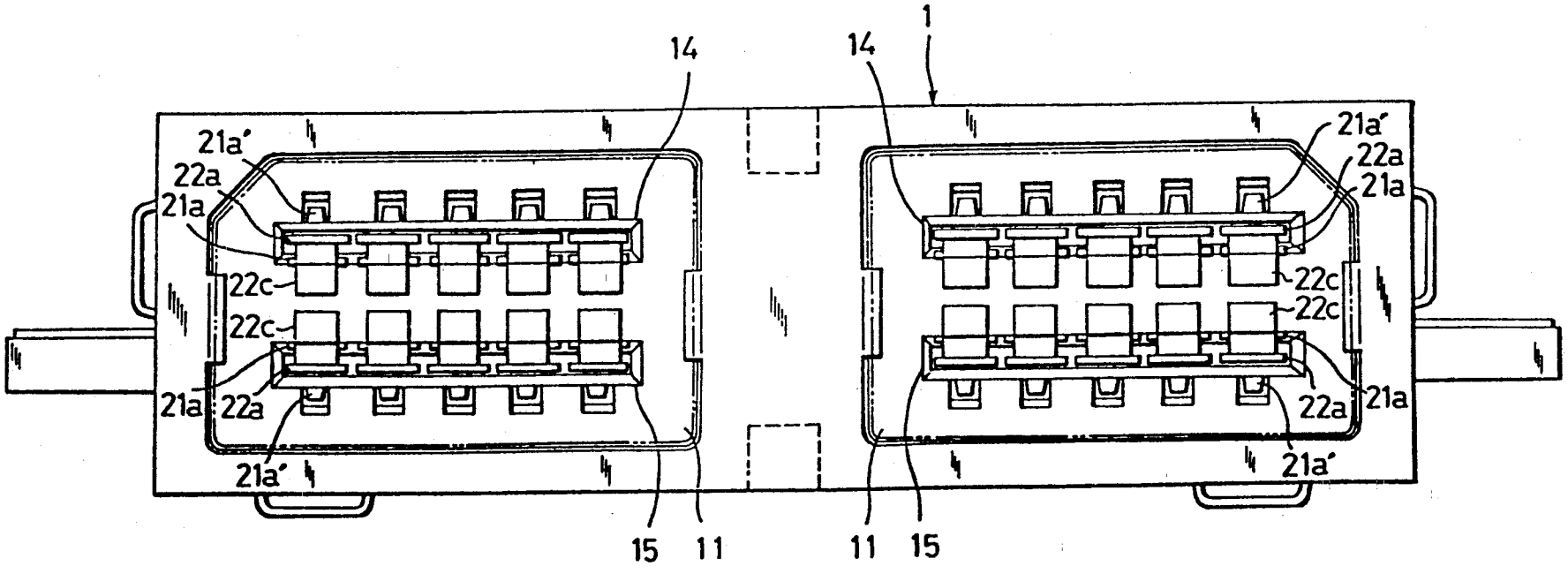
FIG. 2 is a front view of the connector in FIG. 1.
Figure 3:
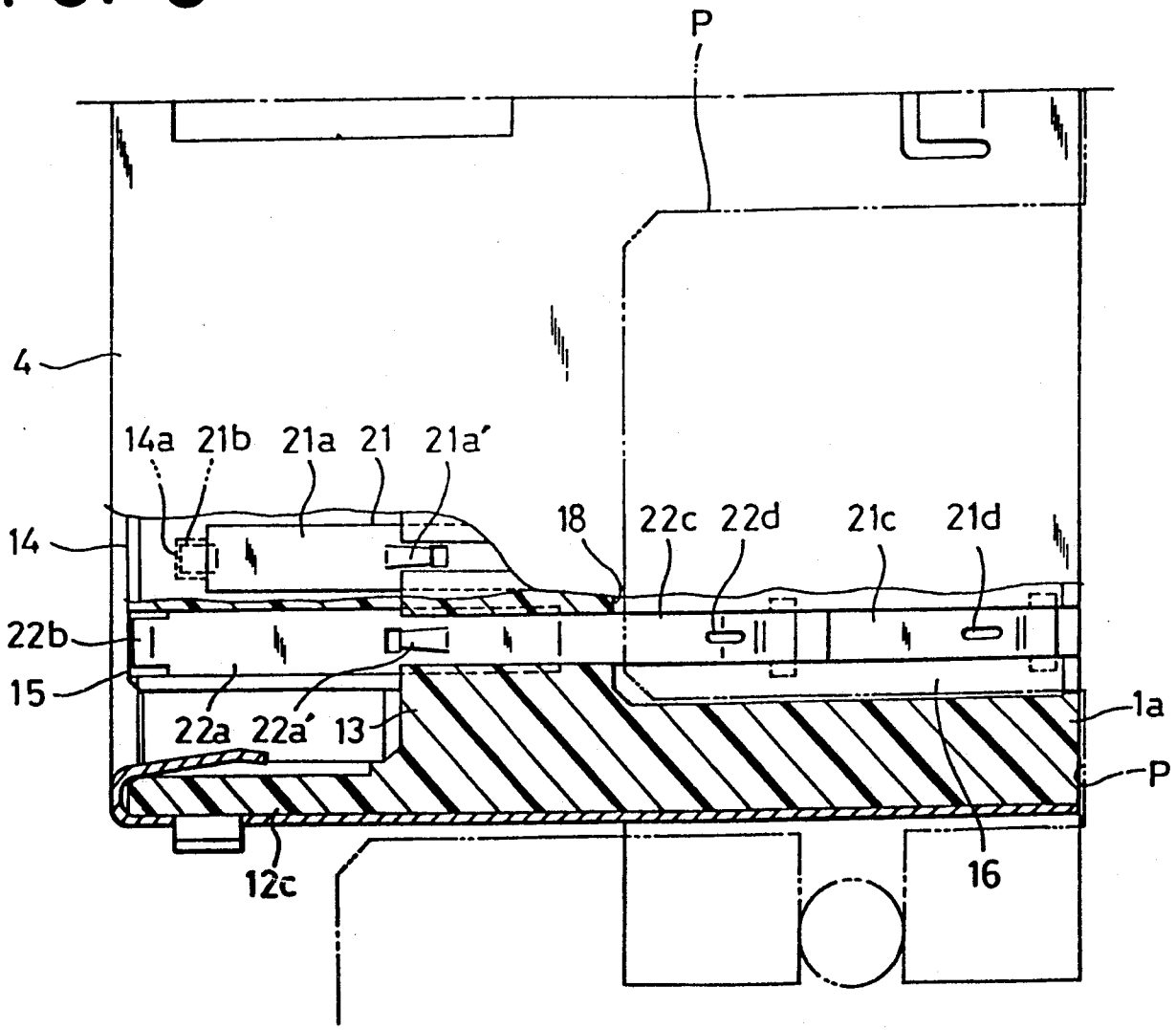
FIG. 3 is a plan view, with portions broken away, of the connector in FIG. 1.

FIGS. 1 to 3 show a multi-pole electrical connector in accordance with an embodiment of the present invention which is of the socket type.

In FIG. 1, the multi-pole electrical connector has a hollow main body 1 in the form of a rectangular parallelpiped. The main body 1 is provided at one end thereof with a connector insertion hole 11 into and from which another multi-pole electrical connector of the plug type is to be inserted and removed. The connector insertion hole 11 is surrounded by upper wall 12*a*, lower wall 12*b* and lateral walls 12*c* of the main body 1. Contact piece holding portions 14, 15 project from a projecting portion 13 formed in the main body 1 at the longitudinally center portion thereof. The contact piece holding portions 14, 15 are respectively disposed in two stages, i.e., upper and lower stages, in the connector insertion hole 11. The main body 1 is provided at the other end thereof with a board insertion hole 17 and at each of the lateral walls 12*c* of the main body 1 with a pair of upper and lower guide ribs 16. In the board insertion hole 17, the pairs of upper and lower guide ribs 16 regulate the insertion/removal passage of a printed circuit board P, and contact surfaces 18 formed at the main body 1 at predetermined spatial intervals between the right- and left-hand guide ribs 16 regulate the setting position of the printed circuit board P. The setting position of the printed circuit board P may be alternately regulated by contacting the end surface of the printed circuit board P with the rear end surface 1*a* of the main body 1.

There are disposed upper and lower pairs of contact pieces 2, each pair 2 being formed by two contact pieces 21, 22.

One contact piece 21 of each upper pair of contact pieces 2 is made of a metallic piece having resiliency. The contact piece 21 has a wide horizontal piece portion 21*a* having a cut-raised engagement pawl 21*a'*, a narrow pawl 21*b* cut and raised at the front end of the horizontal piece portion 21*a*, and a narrow upper extending portion 21*c* which rearwardly extends from the horizontal piece portion 21*a*. A suitable part of the horizontal piece portion 21*a* serves as a contact corresponding to a contact of another multi-pole electrical connector. The upper extending portion 21*c* has an upper bent contact 21*d* corresponding to an external contact $P_1$ (See FIG. 6) formed on the printed circuit board P.

The other contact piece 22 of each upper pair of contact pieces 2 is also made of a metallic piece having resiliency. The contact piece 22 has a wide horizontal piece portion 22*a* having a cut-raised engagement pawl 22*a'*, a narrow pawl 22*b* as formed by bending the front end of the horizontal piece portion 22*a*, and a narrow upper extending portion 22*c* which rearwardly extends from the horizontal piece portion 22*a*. A suitable part of the horizontal piece portion 22*a* serves as a contact corresponding to a contact of another multi-pole electrical connector. The upper extending portion 22*c* has an upper bent contact 22*d* corresponding to an external contact $P_2$ (See FIG. formed on the printed circuit board P.

In the upper contact piece holding portion 14, the transverse end edges of the horizontal piece portion 21*a* of the upper contact piece 21 are inserted in a groove 14*c* formed between the upper contact piece holding portion 14 and a rib 14*b* disposed rearward of the contact piece holding portion 14, and the pawl 21*b* of the contact piece 21 is inserted into a concave engagement groove 14*a* formed in the tip of the upper contact piece holding portion 14. Further, the engagement pawl 21*a'* is engaged with the end surface of the projecting portion 13. Accordingly, the contact piece 21 at one side is held by the main body 1. As to the contact piece 22 at the other side, the transverse end edges of the horizontal piece portion 22*a* of the contact piece 22 are inserted in a groove 14*d* formed in the upper contact piece holding portion 14, and the pawl 22*b* of the contact piece 22 is fitted into a concave portion 14*e* formed in the tip of the upper contact piece holding portion 14. Further, the engagement pawl 22*a'* is engaged with the rear end surface of the contact piece holding portion 14. Accordingly, the contact piece 22 at the other side is held by the main body 1.

In a pair of contact pieces 21, 22 out of the upper pairs of contact pieces 2, the upper contacts 21*d*, 22*d* corresponding to the external contacts $P_1$, $P_2$ of the printed circuit board P, project from above the passage into and from which the printed circuit board P is to be inserted and removed, into this passage. The positions of these upper contacts 21*d*, 22*d* are shifted in the longitudinal direction A in which the printed circuit board P is to be inserted and removed. The distance H between the contacts 21*d*, 22*d* is equal to a pitch H' between the external contacts $P_1$ and $P_2$ of the printed circuit board P shown in FIG. 6.

One contact piece 21 and the other contact piece 22 forming each of the lower pairs of contact pieces 2 are made of metallic pieces having resiliency. At the lower contact piece holding portion 15, these contact pieces 21, 22 are symmetrically disposed, in positional relationship, with respect to the contact pieces 21, 22 at the contact piece holding portion 14. Accordingly, the upper contacts 21*d*, 22*d* are opposite to the lower contacts 21*d*, 22*d* of the two contact pieces 21, 22 forming each of the lower pairs of contact pieces 2 with respect to the insertion/removal passage of the printed circuit board P. The contact piece holding portion 15 has engagement grooves 15*a*, ribs 15*b*, grooves 15*c*, 15*d* and concave portions 15*e*.

In the multi-pole electrical connector above-mentioned, two connector insertion holes 11 are disposed, as juxtaposed, as shown in FIG. 2, but the number of connector insertion holes 11 may be one.

The upper and lower contact piece holding portions 14, 15, and the upper and lower pairs of contact pieces 2 respectively correspond to the single contact piece holding portion 120 and the pairs of contact pieces 130 juxtaposed in one line there at in the conventional connector shown in FIG. 7.

In the printed circuit board P shown in FIG. 6, the external contacts $P_1$, $P_2$ are disposed, with the distance H' above-mentioned provided therebetween, at the top and bottom surfaces of the printed circuit board P, and a predetermined number of the external contacts $P_1$, $P_2$ are transversely disposed.

When mounting the multi-pole electrical connector on the printed circuit board P, it is enough to insert the printed circuit board P, in the direction of an arrow $A_1$, into the board insertion hole 17 as shown by a virtual line in FIG. 1. When the printed circuit board P is inserted in this way, the upper extending portions 21*c*, 22*c* are bent against their resiliency so that the upper contacts 21*d*, 22*d* resiliently come in contact with the external contacts $P_1$, $P_2$ on the top surface of the printed circuit board P, and the lower extending portions 21*c*, 22*c* are bent against their resiliency so that the lower contacts 21*d*, 22*d* resiliently come in contact with the external contacts $P_1$, $P_2$ on the bottom surface of the printed circuit board P. Thus, the two upper contacts 21*d*, 22*d* of each contact piece or the two lower contacts 21*d*, 22*d* of each contact piece resiliently come in contact with the external contacts $P_1$, $P_2$ at two longitudinally different positions on the top or bottom surface of the printed circuit board P. Such an arrangement reduces, by half, the transverse width of the space required for forming the external contacts $P_1$, $P_2$, as compared with the arrangement where the external contacts in the same number are juxtaposed in one line on the printed circuit board P.

Figure 4:
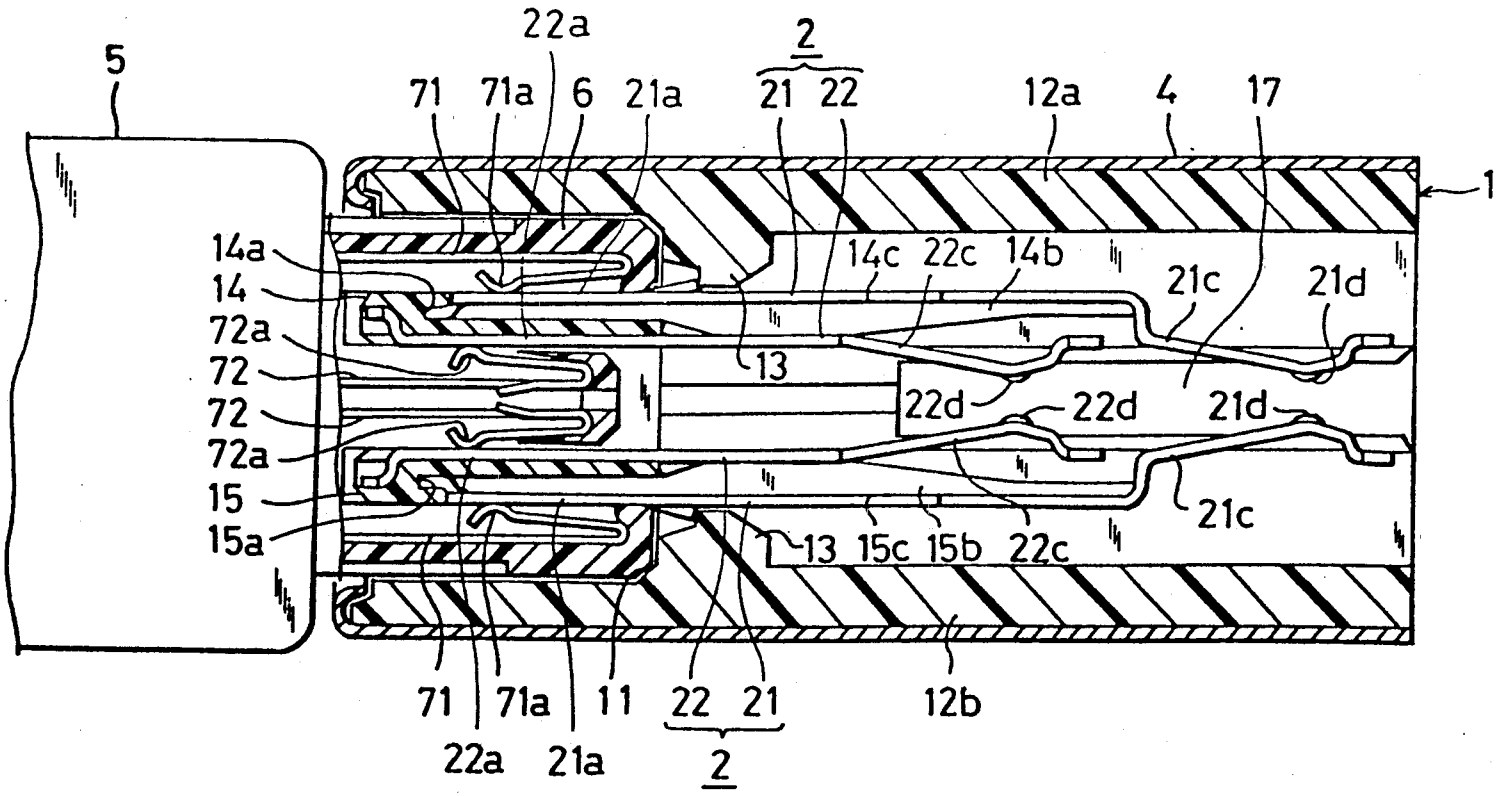
FIG. 4 is a side view, with a portion broken away, of the connector of the present invention as connected to another multi-pole electrical connector.

FIG. 4 shows the multi-pole electrical connector of the socket type as connected to another multi-pole electrical connector of the plug type.

In this other multi-pole electrical connector of the plug type, a main body 6 projecting from a cap houses and holds four contact pieces 71, 72. These contact pieces 71, 72 respectively have contacts 71*a*, 72*a*. The contacts 71*a* correspond to the contacts formed on the horizontal piece portions 21*a* of the multi-pole electrical connector of the socket type, and the contacts 72*a* correspond to the horizontal piece portions 22*a* of the multi-pole electrical connector of the socket type. Accordingly, when this other multi-pole electrical connector is inserted into the connector insertion holes 11, the corresponding contacts, i.e., the contacts 71*a* & the contacts of the horizontal piece portions 21*a* and the contacts 72*a* & the contacts of the horizontal piece portions 22*a* resiliently come in contact with each other. When this other multi-pole electrical connector is pulled out from the connector insertion holes 11, this other multi-pole electrical connector is removed from the multi-pole electrical connector of the socket type.

In the multi-pole electrical connector discussed in connection with FIGS. 1 to 4, the pairs of contact pieces include the upper pairs of contact pieces 2 and the lower pairs of contact pieces 2 which are respectively disposed, as separated from each other, at the upper contact piece holding portion 14 and the lower contact piece holding portion 15. Accordingly, the transverse width of the entire multi-pole electrical connector may be reduced to about half as compared with the arrangement in which all the pairs of contact pieces are juxtaposed in one line. Further, the contacts 21*d*, 22*d* at the upper or lower sides corresponding to the external contacts $P_1$, $P_2$ of the printed circuit board P are positionally shifted in the longitudinal direction A in which the printed circuit board P is to be inserted and removed. Accordingly, even though the transverse width is reduced to about half, the number of poles is the same as that of a connector in which all the pairs of contact pieces are juxtaposed in one line. As to the height of the multi-pole electrical connector, even though the upper contact piece holding portion 14 and the lower contact piece holding portion 15 are formed in two stages in the main body 1, the height of this connector is not doubled but is slightly higher than the height of a connector in which the contact piece holding portion is formed in one stage (such as the conventional connector). Particularly, when the concave engagement grooves 14*a*, 15*a* into which the pawls 21*b* of the upper and lower contact pieces 21 are respectively inserted, and the concaves 14*e*, 15*e* in which the pawls 22*b* of the upper and lower contact pieces 22 are respectively fitted, are positionally shifted in the longitudinal direction in the contact piece holding portions 14, 15 as shown in FIG. 1, the contact piece holding portions 14, 15 may be reduced in thickness as compared with the conventional connector discussed in connection with FIG. 7. This advantageously minimizes the height of the multi-pole electrical connector. This enables the contact pieces 21, 22 to be mounted with high density, thus achieving a high-density mounting of contact pieces and a compact design of the entire configuration.

In the multi-pole electrical connector in FIGS. 1 to 4, the main body 1 is surrounded by a shield plate 4. However, this shield plate 4 is not indispensable.

Figure 5:
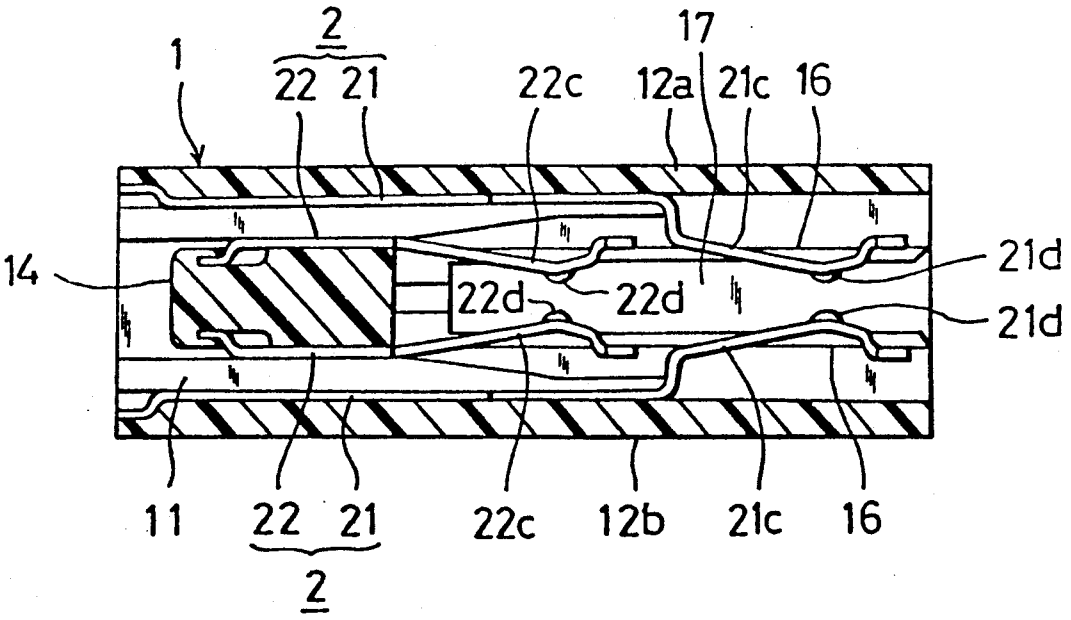
FIG. 5 is a vertical section view of a multi-pole electrical connector in accordance with another embodiment of the present invention.

FIG. 5 shows a multi-pole electrical connector of the socket type in accordance with another embodiment of the present invention. In this multi-pole electrical connector, two contact pieces 21, 22 forming each of the upper pairs of contact pieces 2 are disposed, as separated from each other, at the top surface side of the contact piece holding portion 14 and at the inner surface side of the upper wall 12*a* of the main body 1. These contact pieces 21, 22 extend inside of the board insertion hole 17. Upper contacts 21*d*, 22*d* are respectively formed on the upper extending portions 21*c*, 22*d* of the contact pieces 21, 22. On the other hand, two contact pieces 21, 22 forming each of the lower pairs of contact pieces 2 are disposed, as separated from each other, at the bottom surface side of the contact piece holding portion 14 and at the inner surface side of the lower wall 12*b* of the main body 1. These contact pieces 21, 22 extend inside of the board insertion hole 17. Lower contacts 21*d*, 22*d* are respectively formed on the lower extending portions 21*c*, 22*c* of the contact pieces 21, 22. The arrangement of the connector in FIG. 5 is the same as the arrangement of the connector discussed in connection with FIGS. 1 to 4 in the following points. That is, the contacts 21*d*, 22*d* are positionally shifted in the printed circuit board insertion/removal direction, the main body 1 has the connector insertion hole 11 and the board insertion hole 17, and the upper contacts 21*d*, 22*d* are opposite to the lower contacts 21*d*, 22*d* with respect to the printed circuit board insertion/removal passage.

In the multi-pole electrical connector shown in FIG. 5, too, the upper and lower pairs of contact piece 2 are disposed in two (upper and lower) stages. Such an arrangement reduces, by about half, the entire transverse width of the multi-pole electrical connector, as compared with the arrangement in which the pairs of contact pieces 2 are juxtaposed in one line. Further, the contacts 21*d*, 22*d* corresponding to the external contacts $P_1$, $P_2$ of the printed circuit board P are positionally shifted in the insertion/removal direction of the printed circuit board P. Accordingly, the number of the poles may be the same as that in the arrangement where the pairs of contact pieces 2 are juxtaposed in one line. Further, since the contact piece holding portion 14 is disposed in one stage only, the height of this multi-pole electrical connector is lower than that of the multi-pole electrical connector shown in FIGS. 1 to 4. This achieves a high-density mounting of contact pieces and a compact design of the entire configuration.

What is claimed is:

1. A multi-pole electrical connector, comprising:

a main body having a connector insertion hole into and from which another multi-pole electrical connector is inserted and removed, and a board insertion hole into and from which a printed circuit board is inserted and removed;

upper and lower contact piece holding portions formed integrally with said main body and projecting, in two stages, into said connector insertion hole of said main body each contact piece holding portion having a top surface side and a bottom surface side;

a plurality of upper pairs of contact pieces juxtaposed relative to each other, each upper pair of contact pieces including two contact pieces separated from each other, at the top surface side and the bottom surface side of said upper contact piece holding portion;

an upper contact formed on each of said two contact pieces forming each of said upper pairs of contact pieces, said upper contacts corresponding to contacts of the other multi-pole electrical connector;

an upper extending portion which extends from each of said two contact pieces forming each of said upper pairs of contact pieces and which extend into said board insertion hole;

an upper contact formed on each of said upper extending portions of said two contact pieces forming each of said upper pairs of contact pieces, said upper contacts being positionally shifted, in the insertion/removal direction of the printed circuit board, so as to correspond to external contacts formed on the top surface side of the printed circuit board;

a plurality of lower pairs of contact pieces juxtaposed relative to each other, each lower pair of contact pieces including two contact pieces separated from each other, at the top surface side and the bottom surface side of said lower contact piece holding portion;

a lower contact formed on each of said two contact pieces forming each of said lower pairs of contact pieces, said lower contacts corresponding to contacts of the other multi-pole electrical connector;

a lower extending portion which extends from each of said two contact pieces forming each of said lower pairs of contact pieces and which extend into said board insertion hole; and a lower contact formed on each of said lower extending portions of said two contact pieces forming each of said lower pairs of contact pieces, said lower contacts being positionally shifted, in the insertion/removal direction of the printed circuit board, so as to correspond to external contacts formed on the bottom surface side of the printed circuit board.

2. A multi-pole electrical connector according to claim 1, wherein the respective upper extending portions are opposite to the respective lower extending portions with respect to the insertion/removal passage of the printed circuit board.

3. A multi-pole electrical connector according to claim 1, wherein the lower contact piece holding portion includes a tip portion having an engagement groove and a concave portion disposed at different positions of said tip portion, said different positions being shifted in the longitudinal direction of said main body, and wherein each contact piece of said two contact pieces of said plurality of lower pairs of contact pieces have a tip and a pawl formed on said tip, with one pawl fitted in said engagement groove and one pawl fitted in said concave portion.

4. A multi-pole electrical connector according to claim 1, wherein the upper contact piece holding portion includes a tip portion having an engagement groove and a concave portion disposed at different positions of said tip portion, said different positions being shifted in the longitudinal direction of said main body, and wherein each contact piece of said two contact pieces of said plurality of upper pairs of contact pieces have a tip and a pawl formed on said tip, with one pawl fitted in said engagement groove and one pawl fitted in sad concave portion.

5. A multi-pole electrical connector according to claim 4, wherein the respective upper extending portions are opposite to the respective lower extending portions with respect to the insertion/removal passage of the printed circuit board.

6. A multi-pole electrical connector comprising:

a main body having an upper wall defining an inner surface side, a connector insertion hole into and from which another multi-pole electrical connector is inserted and removed, and a board insertion hole into and from which a printed circuit board is inserted and removed;

a single contact piece holding portion formed integrally with said main body and projecting into said connector insertion hole said contact piece having a top surface side and a bottom surface side;

a plurality of upper pairs of contact pieces juxtaposed relative to each other, each upper pair of contact pieces including two contact pieces disposed at the top surface side of sad contact piece holding portion and at the inner surface side of the upper wall of said main body;

an upper contact formed on each of said two contact pieces forming each of said upper pairs of contact pieces, said upper contacts corresponding to contacts of the other multi-pole electrical connector;

an upper extending portion which extends from each of said two contact pieces forming each of said upper pairs of contact pieces and which extend into said board insertion hole;

an upper contact formed on each of said upper extending portions of said two contact pieces forming each of said upper pairs of contact pieces, said upper contacts being positionally shifted, in the insertion/removal direction of the printed circuit board, so as to correspond to external contacts formed on the top surface said of the printed circuit board;

a plurality of lower pairs of contact pieces juxtaposed relative to each other, each lower pair of contact pieces including two contact pieces disposed at the bottom surface side of sad contact piece holding portion and at the inner surface side of the lower wall of said main body;

a lower contact formed on each of said two contact pieces forming each of said lower pairs of contact pieces, said lower contacts corresponding to contacts of the other multi-pole electrical connector;

a lower extending portion which extends from each of said two contact pieces forming each of said lower pairs of contact pieces and which extend into said board insertion hole; and a lower contact formed on each of said lower extending portions of said two contact pieces forming each of said lower pairs of contact pieces, said lower contacts being positonally shifted, in the insertion/removal direction of the printed circuit board, so as to correspond to external contacts formed on the bottom surface side of the printed circuit board.

* * * * *

UNITED STATES PATENT AND TRADEMARK OFFICE

CERTIFICATE OF CORRECTION

PATENT NO. : 5,110,309

DATED : May 5, 1992

INVENTOR(S) : Norio Ichitsubo

It is certified that error appears in the above-identified patent and that said Letters Patent is hereby corrected as shown below:

Claim 4, column 10, line 54, "sad" should be "said".

Claim 6, column 11, line 6, "sad" should be "said";

column 12, line 1, "said" should be "side";

column 12, line 6, "sad" should be "said"; and column 12, line 21, positonally" should be "positionally".

Signed and Sealed this

Sixth Day of July, 1993

*Attest:*

Michael K. Kirk

MICHAEL K. KIRK

*Attesting Officer*

*Acting Commissioner of Patents and Trademarks*